US007300128B2

(12) United States Patent
Espasa et al.

(10) Patent No.: US 7,300,128 B2
(45) Date of Patent: Nov. 27, 2007

(54) DISTRIBUTING PRINT DENSITY

(75) Inventors: Cesar Fernandez Espasa, San Diego, CA (US); Santiago Garcia-Reyero Vinas, San Diego, CA (US); Virginia Palacios Camarero, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 331 days.

(21) Appl. No.: 11/076,686

(22) Filed: Mar. 10, 2005

(65) Prior Publication Data

US 2006/0203020 A1 Sep. 14, 2006

(51) Int. Cl.
*B41J 2/205* (2006.01)

(52) U.S. Cl. ..... 347/15; 347/16; 347/41

(58) Field of Classification Search ..... 347/15, 347/16, 41, 43

See application file for complete search history.

(56) References Cited

U.S. PATENT DOCUMENTS

| | | | |
|---|---|---|---|
| 4,791,435 | A | 12/1988 | Smith et al. |
| 5,526,027 | A | 6/1996 | Wade et al. |
| 5,610,638 | A | 3/1997 | Courtney |
| 5,673,069 | A | 9/1997 | Canfield et al. |
| 5,714,990 | A | 2/1998 | Courtney |
| 5,736,995 | A | 4/1998 | Bohorquez et al. |
| 5,790,144 | A | 8/1998 | Eade et al. |
| 6,145,959 | A | 11/2000 | Lund et al. |
| 6,278,468 | B1 | 8/2001 | Watrobski et al. |
| 6,283,650 | B1 | 9/2001 | Yamada et al. |
| 6,322,189 | B1 | 11/2001 | Anderson et al. |
| 6,382,758 | B1 | 5/2002 | Chausanski et al. |
| 6,394,572 | B1 | 5/2002 | Pierce et al. |
| 6,435,668 | B1 | 8/2002 | Barbour et al. |
| 6,484,975 | B1 | 11/2002 | Elrod et al. |
| 6,585,343 | B2 | 7/2003 | Bauer |
| 6,634,735 | B1 | 10/2003 | Silverbrook |
| 6,641,242 | B2 | 11/2003 | Canti et al. |
| 6,641,243 | B2 | 11/2003 | Anderson et al. |
| 6,672,709 | B1 | 1/2004 | Silverbrook |
| 6,682,182 | B2 | 1/2004 | Jeanmaire et al. |
| 6,808,243 | B1 | 10/2004 | Markham et al. |
| 6,808,253 | B2 | 10/2004 | Silverbrook |
| 6,827,428 | B2 | 12/2004 | Silverbrook |
| 6,874,864 | B1 * | 4/2005 | Maeda et al. ..... 347/41 |

FOREIGN PATENT DOCUMENTS

| | | |
|---|---|---|
| EP | 1459870 | 9/2004 |
| JP | 2004-174744 | 6/2004 |

OTHER PUBLICATIONS

International Search Report and Written Opinion of the International Searching Authority dated Jun. 22, 2006.

* cited by examiner

*Primary Examiner*—Thinh Nguyen

(57) ABSTRACT

Embodiments for distributing print density are disclosed.

28 Claims, 7 Drawing Sheets

DISTRIBUTING PRINT DENSITY

BACKGROUND

An inkjet printing system may include a printhead and an ink supply which supplies liquid ink to the printhead. The printhead ejects ink drops through a plurality of orifices or nozzles and toward a print medium, such as a sheet of paper, so as to print onto the print medium. Use of an inkjet printing system generates heat on a printhead. If the heat of a printhead becomes too high, the print quality of an inkjet printing system may degrade and a malfunction of the printhead or other inkjet printing system may occur. The heat may be increased with an increase in a firing frequency of a printhead or an increase in the print density of an image being printed. A reduction of the firing frequency of a printhead may increase the amount of time it takes to complete a print job, and a decrease in the print density of an image being printed may result in a lower print quality.

DETAILED DESCRIPTION

In the following detailed description of the embodiments, reference is made to the accompanying drawings, which form a part hereof, and in which is shown by way of illustration in specific embodiments which may be practiced. It is to be understood that other embodiments may be utilized and structural or logical changes may be made without departing from the scope of the present disclosure. The following detailed description, therefore, is not to be taken in a limiting sense.

Figure 1:
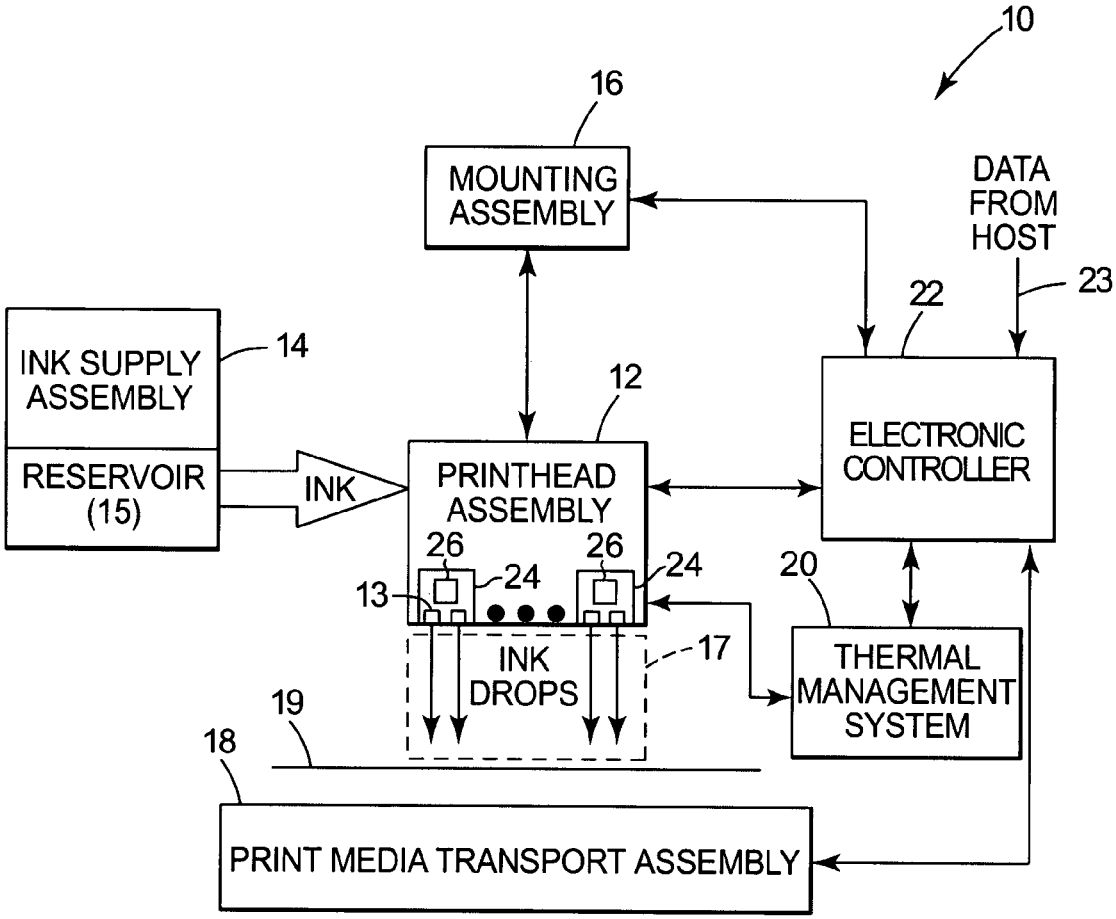
FIG. 1 is a block diagram illustrating an embodiment of an inkjet printing system according to one embodiment of the present disclosure.

FIG. 1 illustrates one embodiment of an inkjet printing system 10 as an example of an image forming system. Inkjet printing system 10 includes an inkjet printhead assembly 12, an ink supply assembly 14, a mounting assembly 16, a print media transport assembly 18, a thermal management system 20, and an electronic controller 22. In one embodiment, inkjet printhead assembly 12 includes one or more printheads 24 which eject drops of ink through a plurality of orifices or nozzles 13 and toward an embodiment of media, such as print medium 19, so as to print onto print medium 19. Print medium 19 includes any type of suitable sheet material, such as paper, cardstock, transparencies, Mylar, cloth, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to inkjet printhead assembly 12 and includes a reservoir 15 for storing ink. As such, ink flows from reservoir 15 to inkjet printhead assembly 12. In one embodiment, inkjet printhead assembly 12 and ink supply assembly 14 are housed together to form an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled.

Mounting assembly 16 supports inkjet printhead assembly 12 relative to print media transport assembly 18. Print media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a non-scanning or fixed printhead assembly. As such, mounting assembly 16 fixes inkjet printhead assembly 12 at a prescribed position relative to print media transport assembly 18. Thus, print media transport assembly 18 advances or positions print medium 19 relative to inkjet printhead assembly 12.

An embodiment of a thermal management system, such as thermal management system 20 sets and manages thermal thresholds associated with printhead assembly 12 to reduce the likelihood that printheads 24 overheat as described in additional detail below in one embodiment. Thermal management system 20 detects an actual temperature of printheads 24 using thermal sensors 26 for each printhead 24 and an ambient temperature for inkjet printing system 10 using another thermal sensor (not shown). Thermal management system 20 includes any suitable combination of hardware and software components such as firmware configured to perform the functions of thermal management system 20 described below. Any software components may be stored on an embodiment of a computer readable medium accessible to a computer or other processing system. In the embodiment of inkjet printing system 10 shown in FIG. 1, the embodiment of a computer readable medium could be included, for example, within thermal management system 20 or electronic controller 22.

Electronic controller 22 communicates with inkjet printhead assembly 12, mounting assembly 16, and print media transport assembly 18. Electronic controller 22 receives data 23 from a host system, such as a computer, and includes memory for temporarily storing data 23. Typically, data 23 is sent to inkjet printing system 10 along an electronic, infrared, optical or other information transfer path. Data 23 represents, for example, a document and/or file to be printed. As such, data 23 forms a print job for inkjet printing system 10 and may include one or more print job commands and/or command parameters.

In one embodiment, electronic controller 22 provides control of inkjet printhead assembly 12 including timing control for ejection of ink drops from nozzles 13. As such, electronic controller 22 defines a pattern of ejected ink drops which form characters, symbols, and/or other graphics or images on print medium 19. Timing control and, therefore, the pattern of ejected ink drops is determined by the print job commands and/or command parameters.

Figure 2:
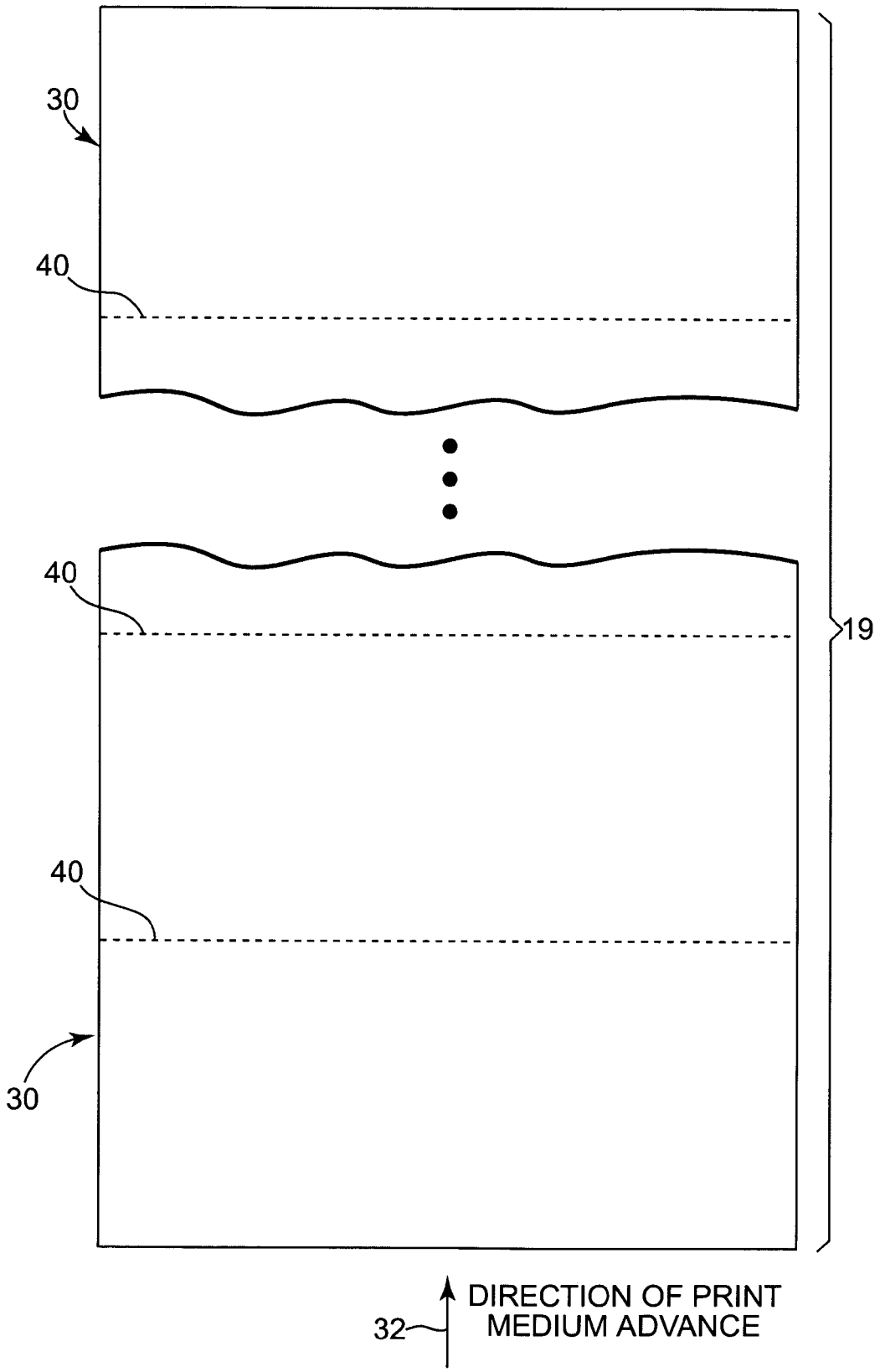
FIG. 2 is a schematic diagram illustrating an embodiment of a portion of a continuous web print medium according to one embodiment of the present disclosure.

In one embodiment, as illustrated in FIG. 2, print medium 19 is a continuous form or continuous web print medium 19. As such, print medium 19 may include a plurality of continuous print medium sections 30. Print medium sections 30 represent, for example, individual sheets, forms, labels, or the like which may be physically separated from each other by cutting or tearing along, for example, perforated lines 40. In addition, print medium 19 may include a continuous roll of unprinted paper with print medium sections 30 individually delineated by indicia, openings, or other markings. Since inkjet printhead assembly 12 is fixed, print medium 19 moves relative to inkjet printhead assembly 12 during printing. More specifically, print medium 19 is advanced relative to inkjet printhead assembly 12 in a direction indicated by arrow 32.

In the process of printing to medium 19, printheads 24 apply energy to resistor elements adjacent to nozzles 13 to heat ink to the boiling point of the ink to cause a bubble of air to form and push ink out of nozzles 13 onto medium 19. As printheads 24 continue to print, heat builds up on printheads 24. If the heat exceeds a thermal limit, printing quality may degrade until some or all of nozzles 13 stop printing.

Two of the primary factors that influence the thermal behavior of printheads 24 are the firing frequency of printheads 24 and the image density of an image being printed to medium 19. With a higher firing frequency, the resistor elements are energized more often and more heat is generated over the same time period compared to a lower frequency. With a higher image density, printheads 24 apply more ink over an area of medium 19 and more heat is generated over the same time period.

In one embodiment, thermal management system 20 accesses temperature information from thermal sensors 26 to monitor the temperature of printheads 24. If the temperature of printheads 24 exceeds a thermal threshold, thermal management system 20 causes inkjet printing system 10 to stop printing to avoid damage to printheads 24.

As described with reference to the embodiments of FIGS. 3 and 4, thermal management system 20 sets the thermal thresholds for printheads 24 using a density profile of each image in a print job. By setting the thermal thresholds using the density profile, inkjet printing system 10 may avoid stopping or slowing printing of the image or reducing the print density of the image because of the use of a thermal threshold that may not be appropriate for that image, while reducing the likelihood of damage to printheads 24 from overheating.

Figure 3:
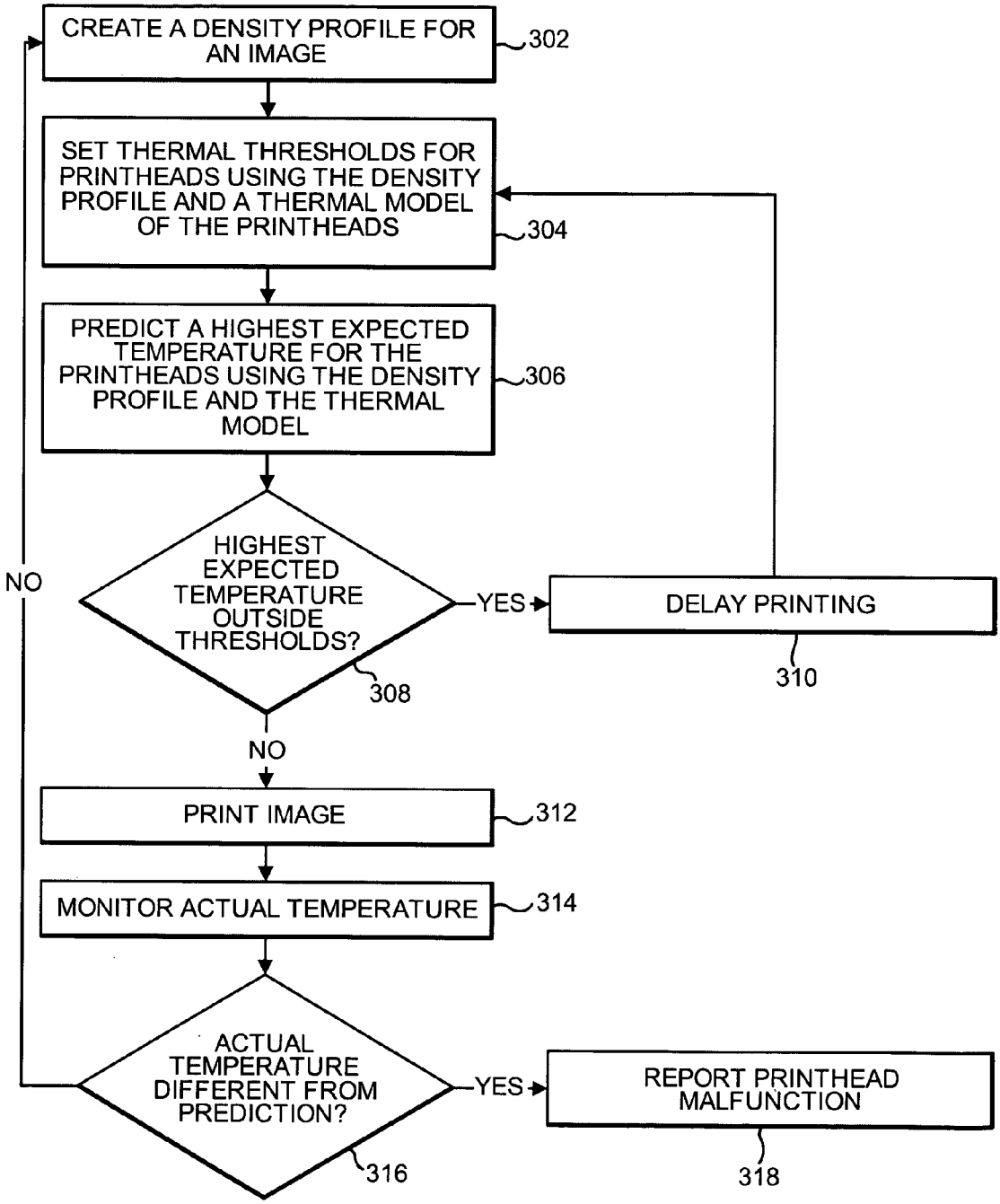
FIG. 3 is a flow chart illustrating an embodiment of a method for managing the temperature of a printhead assembly according to one embodiment of the present disclosure.
Figure 4:
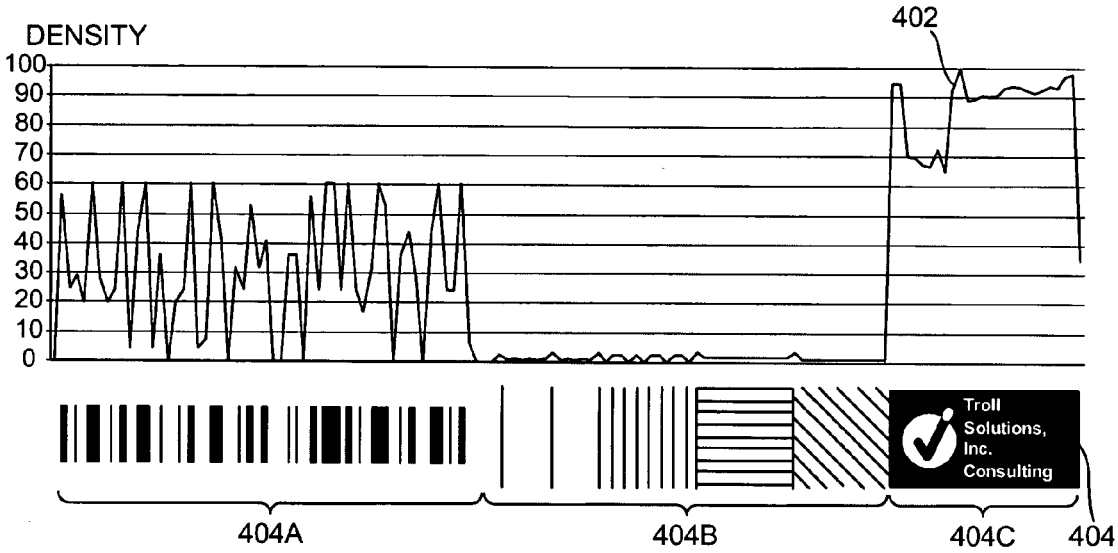
FIG. 4 is a schematic diagram illustrating an embodiment of a density profile for an image according to one embodiment of the present disclosure.

FIG. 3 is a flow chart illustrating one embodiment of a method for managing the temperature of printhead assembly 12. The method illustrated in FIG. 3 is implemented by thermal management system 20 according to one embodiment.

In the embodiment of FIG. 3, thermal management system 20 creates a density profile for an image that is to be printed by inkjet printing system 10 as part of a print job as indicated in a block 302. FIG. 4 is a schematic diagram illustrating a density profile 402 for an image 404. Density profile 402 identifies the print density of image 404 at each point for different regions in image 404. The print density of image 404 represents an amount of ink to be deposited per unit length in the embodiment shown in FIG. 4. For example, relatively moderate print densities are detected in region 404A of image 404, relatively low print densities are detected in region 404B of image 404, and relatively high print densities are detected in region 404C of image 404. The print density correlates with the number of times printheads 24 activate nozzles 13 in printing image 404. By calculating the print density of image 404, thermal management system 20 can estimate the amount of heat that will be generated by printheads 24 in printing image 24 from this print density.

In one embodiment, thermal management system 20 sets thermal thresholds for printheads 24 using the density profile and a thermal model of printheads 24 as indicated in a block 304. Each thermal threshold identifies a thermal level associated with printheads 24 and may trigger an action to be taken by inkjet printing system 10 in response to thermal management system 20 detecting a temperature of printheads 24 that exceeds the thermal threshold. The actions may include aborting or delaying a print job so that printheads 24 will not overheat.

The thermal model includes information that predicts the thermal behavior of printheads 24 based on thermal parameters. In one embodiment, the thermal parameters include the firing frequency of printheads 24, the current temperature of printheads 24, the ambient temperature of inkjet printing system 10, and the trickle warming temperature of inkjet printing system 10. The thermal model may be derived from simulations or experimental use of printheads 24.

In one embodiment, thermal management system 20 predicts a highest expected temperature for printheads 24 for the density profile using the density profile and the thermal model of printheads 24 as indicated in a block 306. A determination is made by thermal management system 20 as to whether the highest expected temperature is outside of the temperature thresholds for printheads 24 as indicated in a block 308. In one embodiment, if the highest expected temperature is outside of the temperature thresholds for printheads 24, then thermal management system 20 causes inkjet printer system 10 to delay printing of the image as indicated in a block 310. By delaying printing of the image, printheads 24 may cool down without aborting the print job. Thermal management system 20 repeats the functions of blocks 304, 306, and 308 at a later time using the density profile created by the function of block 302.

If the highest expected temperature is not outside of the temperature thresholds for printheads 24, then thermal management system 20 causes inkjet printer system 10 to print the image as indicated in a block 312. In one embodiment, during the printing of the image, thermal management system 20 monitors the actual temperature of printheads 24 as indicated in a block 314. During, or subsequent to, printing the image, a determination is made by thermal management system 20 as to whether the actual temperature differs significantly from the predicted maximum temperature as indicated in a block 316. In one embodiment, if the actual temperature differs significantly from the predicted highest expected temperature, i.e., differs by more that a predetermined amount, then thermal management system 20 reports a malfunction of printheads 24 as indicated in a block 318. A printhead malfunction may be caused by an ink short where an accumulation of ink on one or more of printheads 24 causes printheads 24 to overheat or a starvation situation where a lack of ink to one or more nozzles 13 of one or more printheads 24 causes printheads 24 to overheat.

If the actual temperature does not differ significantly from the predicted highest expected temperature at block 316, then thermal management system 20 repeats the method for a next image in a print job. If the next image is identical or substantially identical to the previous image, then thermal management system 20 may omit the function of block 302 and use the density profile of the previous image for the next image to set the thermal thresholds and predict the highest expected temperature. The method continues for each image in a print job or until a printhead malfunction is detected.

Using thermal management system 20 and the embodiment of the method of FIG. 3, different thermal thresholds of printheads 24 may be set for each print job and/or for each image in each print job according to a density profile of an image to be printed. The different thermal thresholds may reduce the likelihood that inkjet printing system 10 stops or slows printing of the image or reduces the print density of the image because of the use of a thermal threshold that is not appropriate for that image.

Figure 5:
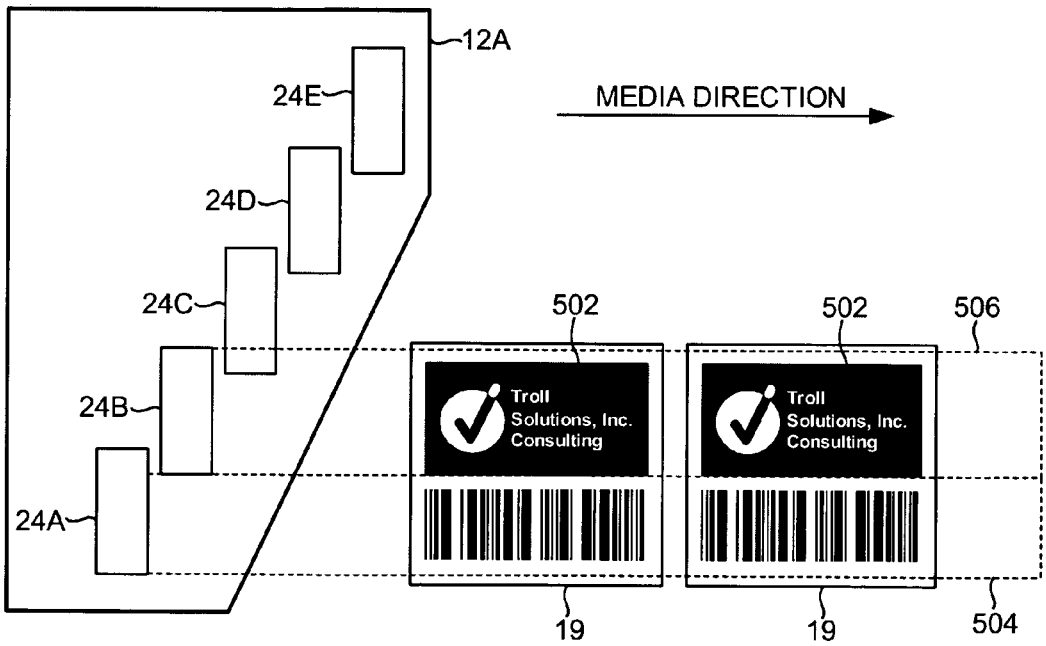
FIG. 5 is a schematic diagram illustrating an embodiment of distributing image density over multiple printheads in a printhead assembly according to one embodiment of the present disclosure.

FIG. 5 is a schematic diagram illustrating one example of distributing image density over multiple printheads 24 in an embodiment 12A of printhead assembly 12. In printhead assembly 12A, five printheads 24A, 24B, 24C, 24D, and 24E are staggered or offset from one another in a direction perpendicular to the media direction produced by print media transport assembly 18. As a result, a print swath of each printhead 24 overlaps with one or two adjacent printheads 24. In other embodiments, printhead assembly 12A includes other numbers of staggered printheads 24.

As shown in the example of FIG. 5, inkjet printing system 10 repetitively prints an image 502 onto media 19. Printhead 24A prints the portion of image 502 covered by a print swath 504, and printhead 24B prints the portion of image 502 covered by a print swath 506. In the example of FIG. 5, the portion of image 502 printed by printhead 24B has a higher print density than the portion of image 502 printed by printhead 24A. As a result, printheads 24A and 24B may heat up unevenly such that printhead 24B heats up faster than printhead 24A. If the temperature of printhead 24B reaches a thermal threshold, the print job that includes image 502 may be stopped or slowed or the print density of image 502 may be reduced.

In one embodiment, to reduce the risk of printheads 24 reaching a thermal threshold, thermal management system 20 causes the print density of image 502 to be distributed over printheads 24A through 24E in an attempt to balance the print densities of printheads 24A through 24E in a print job as described in additional detail with reference to the embodiments of FIGS. 6 through 9.

Figure 6:
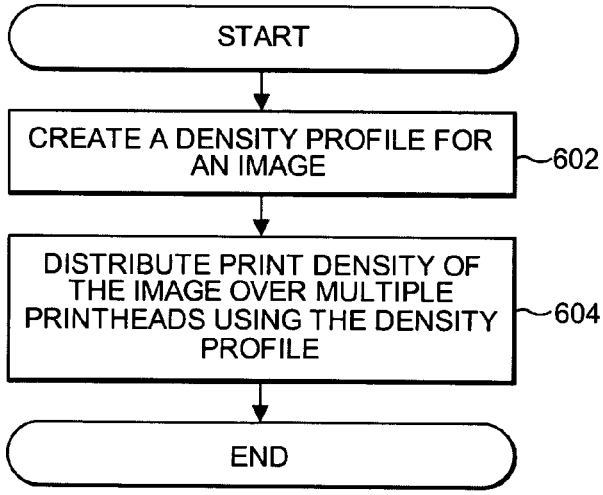
FIG. 6 is a flow chart illustrating an embodiment of a method for distributing image density over multiple printheads in a printhead assembly according to one embodiment of the present disclosure.

FIG. 6 is a flow chart illustrating one embodiment of a method for distributing image density over multiple printheads 24A through 24E in printhead assembly 12A. The method illustrated in FIG. 6 is implemented by thermal management system 20 according to one embodiment.

Figure 8:
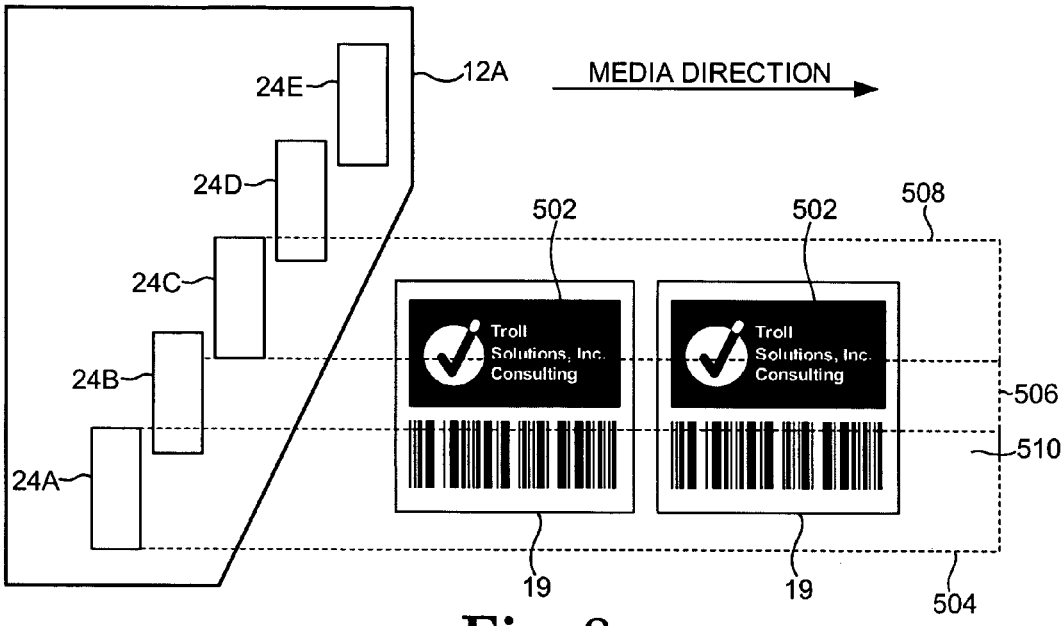
FIG. 8 is a schematic diagram illustrating distributing image density over multiple printheads in a printhead assembly according to one embodiment of the present disclosure.
Figure 9:
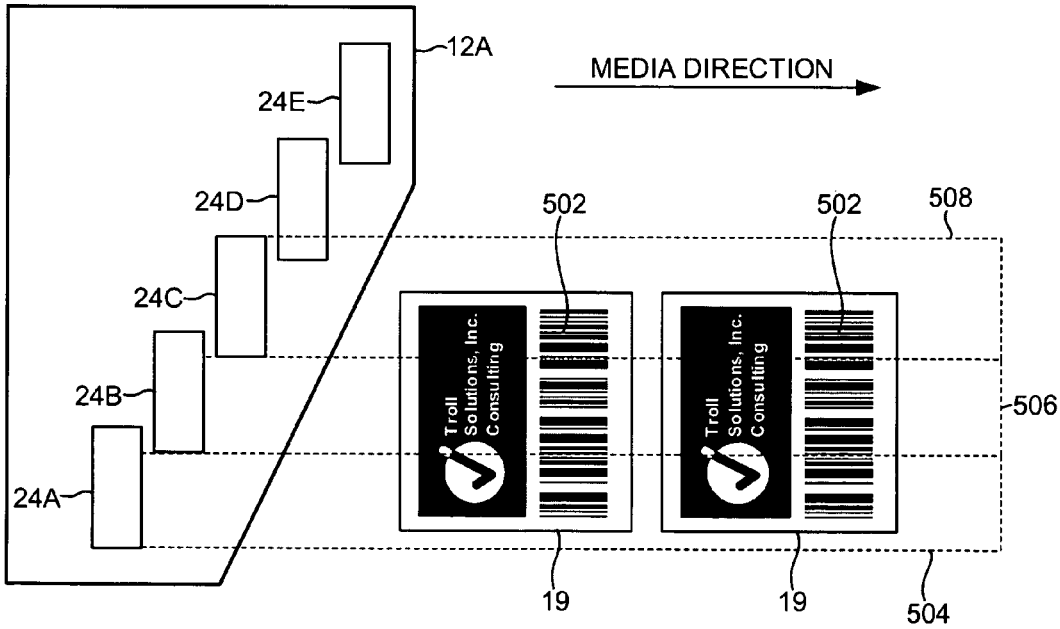
FIG. 9 is a schematic diagram illustrating an embodiment of distributing image density over multiple printheads in a printhead assembly according to one embodiment of the present disclosure.

In the embodiment of FIG. 6, thermal management system 20 creates a density profile for image 502 that is to be printed by inkjet printing system 10 as part of a print job as indicated in a block 602. An example of a density profile for an image is shown in FIG. 4. In one embodiment, thermal management system 20 distributes the print density of image 502 over multiple printheads 24A through 24E in printhead assembly 12A as indicated in a block 604. Thermal management system 20 distributes the print density of image 502 over multiple printheads 24A through 24E using one or more of the techniques illustrated in the embodiments of FIGS. 7, 8, and 9. The techniques include adjusting the relative position between media 19 and printhead assembly 12A as shown in FIG. 7, adjusting the width of the print swaths for one or more of printheads 24A through 24E as shown in FIG. 8, and rotating image 502 and/or media 19 as shown in FIG. 9.

Figure 7:
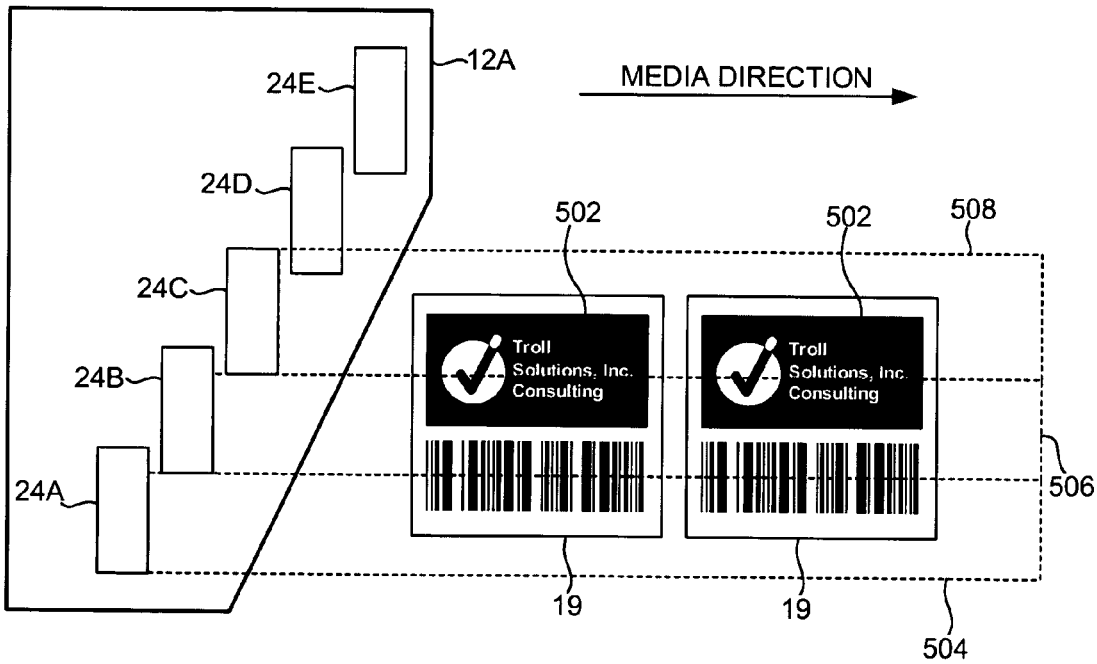
FIG. 7 is a schematic diagram illustrating distributing image density over multiple printheads in a printhead assembly according to one embodiment of the present disclosure.

FIG. 7 is a schematic diagram illustrating one embodiment of distributing image density over multiple printheads 24A through 24E in printhead assembly 12A by adjusting the relative position between media 19 and printhead assembly 12A. In the embodiment of FIG. 7, the relative position between media 19 and printhead assembly 12A is adjusted, either manually or by thermal management system 20, such that the image density of image 502 is distributed between printheads 24A, 24B, and 24C as indicated by print swaths 504, 506, and 508, respectively.

To adjust the relative position between media 19 and printhead assembly 12A, either media 19 is moved relative to printhead assembly 12A or printhead assembly 12A is moved relative to media 19 during a print job setup, or possibly both are moved at least some amount to achieve the desired positional relationship between printhead assembly 12A and media 19. In one embodiment, a user manually adjusts media 19 and/or printhead assembly 12A. To print image 502 in media 19, either the user provides inputs to inkjet printing system 10 to identify the relative position between media 19 and printhead assembly 12A or electronic controller automatically identifies the relative position between media 19 and printhead assembly 12A.

In another embodiment, thermal management system 20 creates the density profile of image 502 and either automatically adjusts the relative position between media 19 and printhead assembly 12A or provides information such as alignment arrows to a user so that the user adjusts the relative position between media 19 and printhead assembly 12A.

FIG. 8 is a schematic diagram illustrating one example of distributing image density over multiple printheads 24A through 24E in printhead assembly 12A by adjusting the width of the print swaths for one or more of printheads 24A through 24E. In the example of FIG. 8, thermal management system 20 adjusts the width of print swaths 504 and 506 for printheads 24A and 24B, respectively, to more evenly distribute the image density of image 502 between printheads 24A and 24B using the density profile for image 502.

As illustrated in the embodiment of FIG. 8, print swaths 504 and 506 overlap in region 510. Accordingly, thermal management system 20 may select printhead 24A and/or printhead 24B to print the area of image 502 covered by region 510. With the placement of media 19 and image 502 shown in FIG. 8, thermal management system 20 compares the image density of print swaths 504, 506, and 508 using the density profile. Because the image density of image 502 is higher in one portion of the image than another, thermal management system 20 increases the width of print swath 504 for printhead 24A and decreases the width of print swath 506 for printhead 24B in the example of FIG. 8.

Thermal management system 20 adjusts the width of print swaths for each printhead 24A through 24E using the density profile of an image as described in the example of FIG. 8.

FIG. 9 is a schematic diagram illustrating one embodiment of distributing image density over multiple printheads 24A through 24E in printhead assembly 12A by rotating image 502 and media 19. In the embodiment of FIG. 9, image 502 and media 19 are rotated by 90 degrees such that the image density of image 502 is distributed between printheads 24A, 24B, and 24C as indicated by print swaths 504, 506, and 508, respectively.

Thermal management system 20 creates the density profile of image 502 and causes image 502 19 to be rotated by a selected amount, e.g., 90 or 270 degrees, such that the image density of image 502 is distributed between printheads 24A through 24E. If desired, thermal management system 20 also causes media 19 to be rotated either automatically or by providing information to a user to cause the user to rotate media 19 appropriately.

Using thermal management system 20, the embodiment of the method of FIG. 6, and the embodiments illustrated in FIGS. 7, 8, and 9, the print density of an image may be distributed over multiple printheads. By distributing the print density of an image over multiple printheads, thermal management system 20 may prevent inkjet printing system 10 from stopping or slowing printing of an image or reducing the print density of the image due to thermal thresholds of printheads 24.

Figure 10:
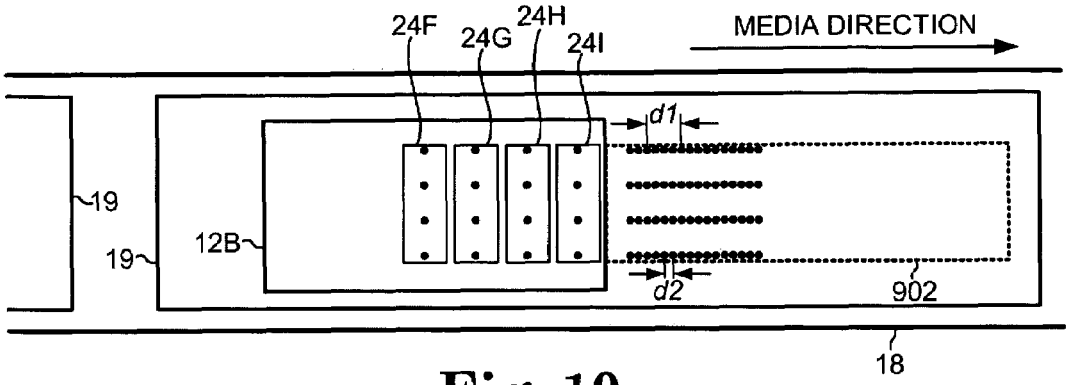
FIG. 10 is a schematic diagram illustrating an embodiment of a printhead assembly with cascading printheads according to one embodiment of the present disclosure.

FIG. 10 is a schematic diagram illustrating an embodiment 12B of printhead assembly 12 with four cascading printheads 24F, 24G, 24H and 24I. In printhead assembly 12B, printheads 24F through 24I are aligned in a direction parallel to the media direction produced by print media transport assembly 18 such that they each print in a fully or substantially fully overlapping print swath 902. The cascade arrangement of printheads 24F through 24I may allow inkjet printing system to increase the speed with which print jobs are completed. In other embodiments, printhead assembly 12B includes other numbers of cascading printheads 24.

In one embodiment, printheads 24F through 24I print in an interlaced pattern where each printhead 24F through 24I prints, for example, every fourth column. The distance between every fourth column at a highest firing frequency used in the embodiment is shown as distance d1 and may be 1/150 inch in one embodiment. The distance between individual columns at a highest firing frequency used in the embodiment is shown as distance d2 and may be 1/600 inch in one embodiment.

Figure 11:
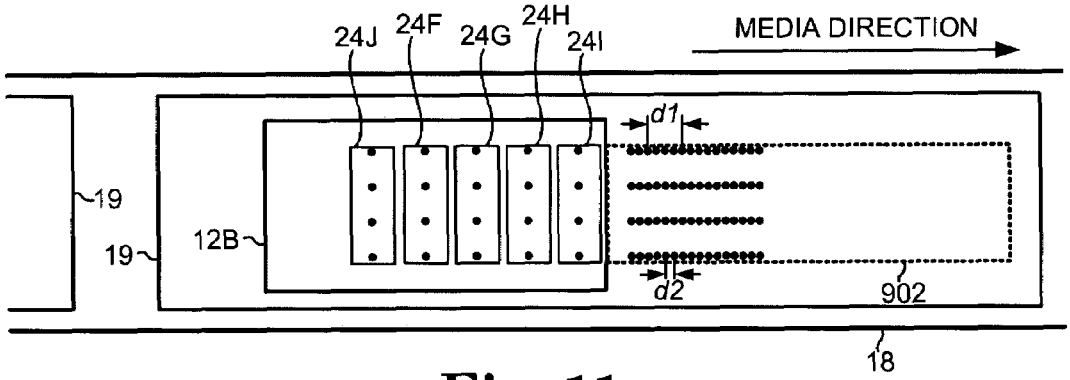
FIG. 11 is a schematic diagram illustrating an embodiment of a printhead assembly with a redundant printhead in a set of cascading printheads according to one embodiment of the present disclosure.

To reduce the risk of printheads 24 reaching a thermal threshold, at least one redundant printhead 24J is added to printhead assembly 12B as shown in the embodiment of FIG. 11. By adding redundant printhead 24J, the printing of a print job may be distributed among printheads 24F through 24J. As a result, the risk of any one of printheads 24F through 24J reaching a thermal threshold may be reduced. In other embodiments, additional redundant printheads 24 may be added to printhead assembly 12B.

In the embodiment of FIG. 11, thermal management system 20 distributes print density among printheads 24F through 24J by alternately idling, i.e., not using, one of printheads 24F through 24J during selected portions of a print job.

In one embodiment, thermal management system 20 distributes print density among printheads 24F through 24J by printing each image in a print job with a subset of printheads 24F through 24J, i.e., less than all of printheads 24F through 24J. For example, thermal management system 20 causes printheads 24F through 24I to print a first image of a print job (with printhead 24J idle), thermal management system 20 causes printheads 24G through 24J to print a second image of a print job (with printhead 24F idle), thermal management system 20 causes printheads 24F and 24H through 24J to print a third image of a print job (with printhead 24G idle), thermal management system 20 causes printheads 24F, 24G, 24I, and 24J to print a fourth image of a print job (with printhead 24H idle), and thermal management system 20 causes printheads 24F through 24H and 24J to print a fifth image of a print job (with printhead 24I idle). Thermal management system 20 continues to rotate through the subsets of printheads 24F through 24J in printing the print job in this example. In other examples, thermal management system 20 includes other numbers of printheads 24 in each subset and/or causes other numbers of printheads 24 to be idle at a given time or for a given image.

In another embodiment, thermal management system 20 distributes print density among printheads 24F through 24J by printing a print job such that each of printheads 24F through 24J prints a non-contiguous set of columns, e.g., every mth column of each image in the print job, where m is an integer equal to the number of printheads 24 in printhead assembly 12B (e.g., five).

Figure 12:
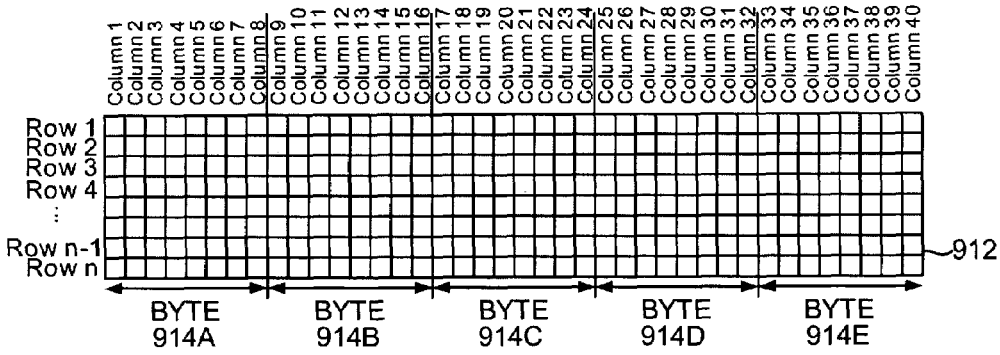
FIG. 12 is a schematic diagram illustrating an embodiment of a method for printing an image with a printhead assembly that includes a redundant printhead according to one embodiment of the present disclosure.

FIG. 12 is a schematic diagram illustrating one embodiment of a method for printing an image 912 with printhead assembly 12B. Image 912 includes rows 1 through n, where n is an integer equal to a number of rows that may be printed by printhead assembly 12B, and columns 1 through 40.

With reference to image 912, in one embodiment, thermal management system 20 causes printhead 24F to print columns 1, 6, 11, etc., thermal management system 20 causes printhead 24G to print columns 2, 7, 12, etc., thermal management system 20 causes printhead 24H to print columns 3, 8, 13, etc., thermal management system 20 causes printhead 24I to print columns 4, 9, 14, etc., and thermal management system 20 causes printhead 24I to print columns 5, 10, 15, etc. To do so, thermal management system 20 maps the image data for image 912 to printheads 24F through 24I to cause each printhead 24 to print every fifth column of image 912.

In a further embodiment, thermal management system 20 distributes print density among printheads 24F through 24J by printing a designated portion, e.g., a contiguous set of columns that forms a byte, of each image in a print job with a subset of printheads 24F through 24J, i.e., less than all of printheads 24F through 24J. For example, thermal management system 20 causes printheads 24F through 24I to print a first byte 914A of image 912 (with printhead 24J idle), thermal management system 20 causes printheads 24G through 24J to print a second byte 914B of image 912 (with printhead 24F idle), thermal management system 20 causes printheads 24F and 24H through 24J to print a third byte 914C of image 912 (with printhead 24G idle), thermal management system 20 causes printheads 24F, 24G, 24I, and 24J to print a fourth byte 914D of image 912 (with printhead 24H idle), and thermal management system 20 causes printheads 24F through 24H and 24J to print a fifth byte 914E of image 912 (with printhead 24I idle). Thermal management system 20 continues to rotate through the subsets of printheads 24F through 24J in printing bytes of the print job in this example. In other examples, thermal management system 20 includes other numbers of printheads 24 in each subset and/or causes other numbers of printheads 24 to be idle at a given time or for a given byte or other portion size of image 912.

By adding redundant printhead 24J to printhead assembly 12B, the printing of a print job may be distributed among a larger number of printhead 24 to reduce the risk of any one of printheads 24 reaching a thermal threshold. As a result, thermal management system 20 may reduce the likelihood of inkjet printing system 10 from stopping or slowing printing of an image or reducing the print density of the image due to reaching thermal thresholds of printheads 24. In addition, the longevity of printheads 24 may be increased.

Although specific embodiments have been illustrated and described herein for purposes of description of the embodiments, it will be appreciated by those of ordinary skill in the art that a wide variety of alternate and/or equivalent implementations may be substituted for the specific embodiments shown and described without departing from the scope of the present disclosure. Those with skill in the optical, mechanical, electromechanical, electrical, and computer arts will readily appreciate that the present disclosure may be implemented in a very wide variety of embodiments. This application is intended to cover any adaptations or variations of the embodiments discussed herein. Therefore, it is manifestly intended that the claimed subject matter be limited only by the claims and the equivalents thereof.

What is claimed is:

1. An image forming system, comprising:

means for creating a density profile associated with an image; and means for distributing a print density of the image over a plurality of printheads according to the density profile by causing a relative position between the plurality of printheads and a print medium to be adjusted.

2. The image forming system of claim 1 wherein the means for distributing the print density of the image includes means for adjusting a print swath of at least one of the plurality of printheads.

3. The image forming system of claim 1 wherein the means for distributing the print density of the image includes means for causing the image to be rotated with respect to the print medium.

4. The image forming system of claim 1 wherein the means for distributing the print density of the image includes means for causing the print medium to be rotated.

5. The image forming system of claim 1 wherein the plurality of printheads are in a staggered arrangement.

6. The image forming system of claim 1 further comprising:

means for providing information to a user to allow the user to adjust the relative position.

7. A method, comprising:

creating a density profile associated with an image; and distributing a print density of the image over a plurality of printheads according to the density profile by causing a relative position between the plurality of printheads and a print medium to be adjusted.

8. The method of claim 7 wherein:

the distributing the print density of the image includes adjusting a print swath of at least one of the plurality of printheads.

9. The method of claim 7 wherein: the distributing the print density of the image includes causing the image to be rotated with respect to the print medium.

10. The method of claim 7 wherein:

the distributing the print density of the image includes causing the print medium to be rotated.

11. The method of claim 7 wherein the plurality of printheads are in a staggered arrangement.

12. The method of claim 7 further comprising:

providing information to a user to allow the user to adjust the relative position.

13. A method performed by an image forming system including a printhead assembly with a plurality of printheads, the method comprising:

a step for providing a density profile associated with an image; and a step for reducing a print density of the image allocated to ones of the plurality of printheads according to the density profile by causing a relative position between the plurality of printheads and a print medium to be adjusted.

14. An image forming system comprising:

a plurality of printheads; and a thermal management system configured to create a density profile for an image and to distribute a print density of the image over the plurality of printheads according to the density profile by causing a relative position between the plurality of printheads and a print medium to be adjusted.

15. The image forming system of claim 14 wherein the thermal management system is configured to distribute the print density of the image by adjusting a print swath of at least one of the plurality of printheads.

16. The image forming system of claim 14 wherein the thermal management system is configured to distribute the print density of the image by causing the image to be rotated with respect to the print medium.

17. The image forming system of claim 14 wherein the thermal management system is configured to distribute the print density of the image by causing the print medium to be rotated.

18. The image forming system of claim 14 wherein the thermal management system is configured to provide information to a user to allow the user to adjust the relative position.

19. An apparatus comprising:

a thermal management system configured to create a density profile associated with an image and configured to cause a print density of the image to be distributed over a plurality of printheads according to the density profile by causing a relative position between the plurality of printheads and a print medium to be adjusted.

20. The apparatus of claim 19 wherein the thermal management system is configured to distribute the print density of the image by adjusting a print swath of at least one of the plurality of printheads.

21. The apparatus of claim 19 wherein the thermal management system is configured to distribute the print density of the image by causing the image to be rotated with respect to the print medium.

22. The apparatus of claim 19 wherein the thermal management system is configured to distribute the print density of the image by causing the print medium to be rotated.

23. The apparatus of claim 19 wherein the thermal management system is configured to provide information to a user to allow the user to adjust the relative position.

24. A computer readable medium having instructions for causing a computer to execute a method comprising:

creating a density profile associated with an image; and distributing a print density of the image over a plurality of printheads according to the density profile by causing a relative position between the plurality of printheads and a print medium to be adjusted.

25. The computer readable medium of claim 24 having instructions for causing the computer to execute the method comprising:

distributing the print density of the image by adjusting a print swath of at least one of the plurality of printheads.

26. The computer readable medium of claim 24 having instructions for causing the computer to execute the method comprising:

distributing the print density of the image by causing the image to be rotated with respect to the print medium.

27. The computer readable medium of claim 24 having instructions for causing the computer to execute the method comprising:

distributing the print density of the image by causing the print medium to be rotated.

28. The computer readable medium of claim 24 having instructions for causing the computer to execute the method comprising:

providing information to a user to allow the user to adjust the relative position.

* * * * *